US007755554B2

(12) United States Patent
Shih

(10) Patent No.: US 7,755,554 B2
(45) Date of Patent: Jul. 13, 2010

(54) ANTENNA

(75) Inventor: Yen-Yi Shih, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 25 days.

(21) Appl. No.: 12/164,129

(22) Filed: Jun. 30, 2008

(65) Prior Publication Data

US 2009/0128418 A1 May 21, 2009

(30) Foreign Application Priority Data

Nov. 16, 2007 (CN) ..... 2007 1 0202575

(51) Int. Cl.
*H01Q 1/38* (2006.01)
*H01Q 1/24* (2006.01)

(52) U.S. Cl. ..... 343/729; 343/702; 343/828

(58) Field of Classification Search ..... 343/700 MS, 343/702, 725, 729, 828, 846
See application file for complete search history.

(56) References Cited

U.S. PATENT DOCUMENTS 3,838,429 A * 9/1974 Reggia ..... 343/750
3,852,760 A * 12/1974 Reggia ..... 343/747
3,967,276 A * 6/1976 Goubau ..... 343/752
4,242,685 A * 12/1980 Sanford ..... 343/770
5,181,044 A * 1/1993 Matsumoto et al. ..... 343/752
5,539,418 A * 7/1996 Egashira et al. ..... 343/712
5,568,157 A * 10/1996 Anderson ..... 343/713

FOREIGN PATENT DOCUMENTS

TW I234901 6/2005
TW 200803053 1/2008

* cited by examiner

*Primary Examiner*—Michael C Wimer
(74) *Attorney, Agent, or Firm*—Frank R. Niranjan

(57) ABSTRACT

An antenna (100) disposed on a first substrate (10) and a second substrate (20) includes a feeding portion (110) and a radiating portion (120). The feeding portion (110) is disposed on a first surface of the first substrate (10), for feeding electromagnetic signals. The radiating portion (120) connected to the feeding portion (110) for transceiving electromagnetic signals includes a first radiator (121), a second radiator (122) and a third radiator (123). The first radiator (121) is disposed on the first surface and connected to the feeding portion (110). The second radiator (122) is disposed on a second surface of the second substrate (20). The third radiator (123) includes a first cylinder portion (1231) and a second cylinder portion (1232) connected to the first cylinder portion (1231). The first cylinder portion (1231) and the second cylinder portion (1232) are connected to the first radiator (121) and the second radiator (122), respectively.

9 Claims, 5 Drawing Sheets

ANTENNA

BACKGROUND

1. Field of the Invention

The present invention relates to antennas, and particularly to an antenna used in wireless local area network (WLAN) devices.

2. Description of Related Art

Recently, there has been significant growth in WLAN (wireless local area network) technology due to the ever growing demand for wireless communication products. Such growth becomes particularly prominent after the promulgation of IEEE 802.11 WLAN protocol in 1997. The IEEE 802.11 WLAN protocol not only offers many novel features to the current wireless communication technologies, but also provides a solution for enabling two wireless communication products manufactured by different companies to communicate with each other.

Antennas are necessary components in the wireless communication devices for radiating electromagnetic signals. In order to obtain a small size of the wireless communication device, the antennas associated therewith are correspondingly required to have a reduced size, as well as meet higher performance standards.

SUMMARY

An exemplary embodiment of the present invention provides an antenna. The antenna disposed on a first substrate and a second substrate includes a feeding portion and a radiating portion. The feeding portion is disposed on a first surface of the first substrate, for feeding electromagnetic signals. The radiating portion is electronically connected to the feeding portion, for transceiving the electromagnetic signals. The radiating portion includes a first radiator, a second radiator and a third radiator. The first radiator is disposed on the first surface of the first substrate and electronically connected to the feeding portion. The second radiator is disposed on a second surface of the second substrate. The third radiator includes a first cylinder portion and a second cylinder portion electronically connected to the first cylinder portion. The first cylinder portion and the second cylinder portion are electronically connected to the first radiator and the second radiator, respectively.

Another exemplary embodiment of the present invention provides a wireless local area network (WLAN) antenna. The WLAN antenna includes a feeding portion and a radiating portion. The feeding portion is disposed on a first plane for feeding electromagnetic signals. The radiating portion is electronically connected to the feeding portion for transceiving electromagnetic signals, comprising a first radiator, a second radiator and a third radiator. The first radiator is disposed on the first plane and electronically connected to the feeding portion. The second radiator is disposed on a second plane. The first plane is paralleled to the second plane. The third radiator is resiliently connected the first radiator to the second radiator.

Other objectives, the advantages and novel features of the present invention will become more apparent from the following detailed description of preferred embodiment when taken in conjunction with the accompanying drawings, in which:

DETAILED DESCRIPTION OF THE EMBODIMENTS

Figure 1:
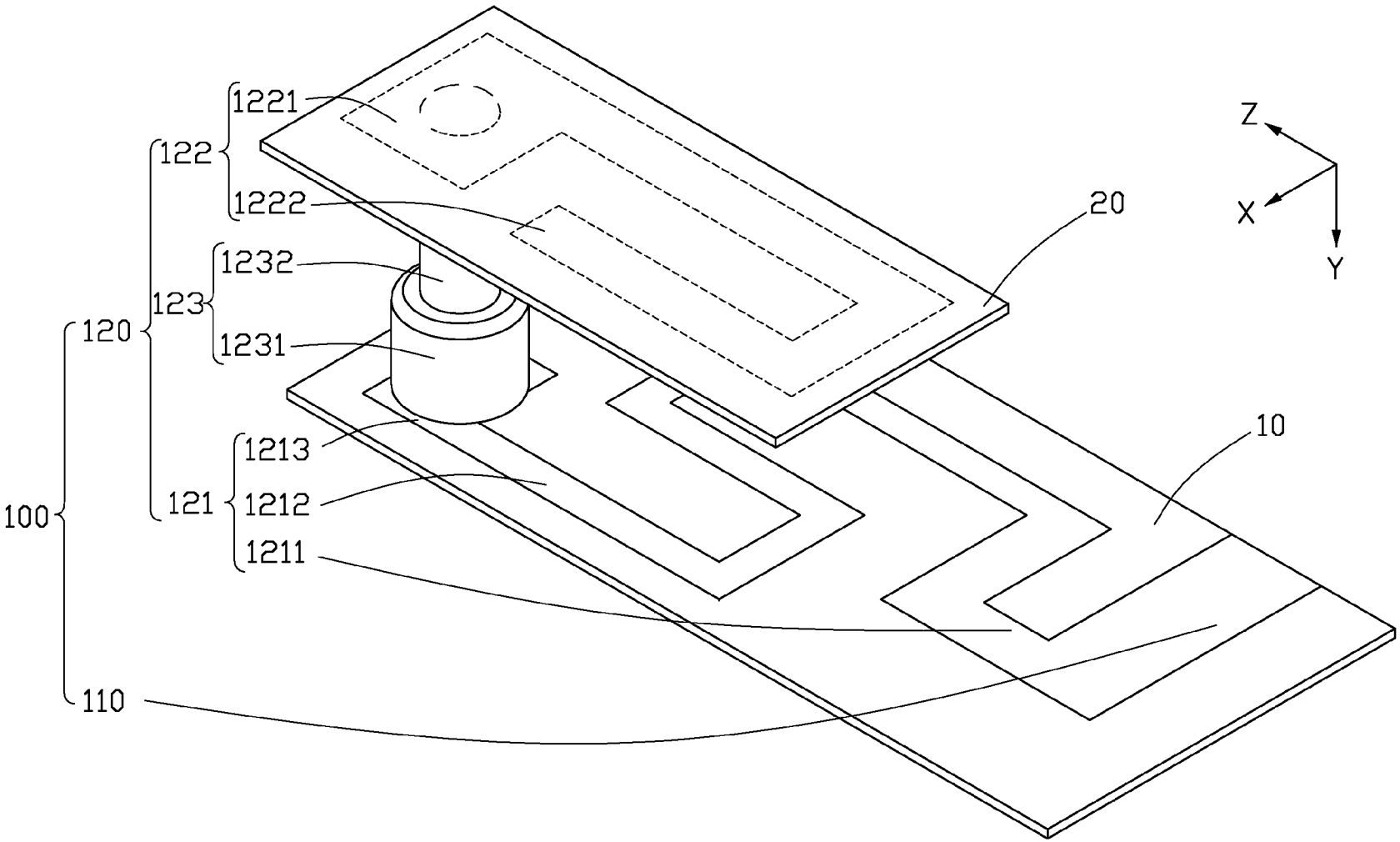
FIG. 1 is a schematic diagram of an antenna in accordance with an exemplary embodiment of the present invention.

FIG. 1 is a schematic diagram of an antenna 100 in accordance with an exemplary embodiment of the present invention. The antenna 100, disposed on a first substrate 10 defining a first plane thereon and a second substrate 20 defining a second plane thereon, includes a feeding portion 110 and a radiating portion 120. The feeding portion 110 is disposed on a first surface of the first substrate 10, for feeding electromagnetic signal. The radiating portion 120 is electronically connected to the feeding portion 110, for transceiving electromagnetic signal. The radiating portion 120 includes a first radiator 121, a second radiator 122, and a third radiator 123. The first radiator 121 and the second radiator 122 are disposed on the first substrate 10 and the second substrate 20 respectively. The third radiator 123 is vertically disposed between the first substrate 10 and the second substrate 20, and is electronically connected to the first radiator 121 and the second radiator 122. In this embodiment, the first radiator 121 is disposed on the first surface of the first substrate 10, and the second radiator 122 is disposed on a second surface of the second substrate 20. The first surface of the first substrate 10 faces the second surface of the second substrate 20.

The first radiator 121 includes an L-shaped portion 1211, an S-shaped portion 1212, and a rectangle-shaped portion 1213 connected in sequence. In this embodiment, the rectangle-shaped portion 1213 is electronically connected to the third radiator 123, and the L-shaped portion 1211 is electronically connected to the feeding portion 110. The L-shaped portion 1211, the S-shaped portion 1212 and the rectangle-shaped portion 1213 co-form a bent shape to reduce the size of the first radiator 121.

The second radiator 122 includes a rectangle-shaped portion 1221 and an n-shaped portion 1222. The rectangle-shaped portion 1221 is electronically connected to an end of the n-shaped portion 1222, for reducing the size of the second radiator 122.

The third radiator 123 includes a first cylinder portion 1231 and a second cylinder portion 1232. The first cylinder portion 1231 and the second cylinder portion 1232 are connected to the rectangle-shaped portion 1213 of the first radiator 121 and the rectangle-shaped portion 1221 of the second radiator 122, respectively. The first cylinder portion 1231 and the second cylinder portion 1232 are homocentric cylinders, and the radius of the first cylinder portion 1231 is bigger than that of the second cylinder portion 1232. The first cylinder portion 1231 is electronically connected to the second cylinder portion 1232, co-forming a metal spring thimble to connect the first radiator 121 and the second radiator 122. Due to the metal spring thimble, the second radiator 122 and the third radiator 123 can be connected and disconnected flexibly, and thereby the antenna 100 is assembled conveniently. For instance, when the antenna 100 of the present invention is used in a cell phone, the first radiator 121 and the third radiator 123 may be disposed on a body of the cell phone, and the second radiator 122 may be disposed on a back cover of the cell phone. When the back cover is closed to the body of the cell phone, the second radiator 122 and the first radiator 121 are connected to the third radiator 123 to co-form the antenna 100 of the present invention.

In this embodiment, the feeding portion 110 and the first radiator 121 are printed on the first surface of the first substrate 10. The first cylinder portion 1231 of the third radiator 123 and the rectangle-shaped portion 1213 of the first radiator 121 are vertically connected by jointing. The second radiator 122 is printed on the second surface of the second substrate 20. The rectangle-shaped portion 1221 of second radiator 122 is electronically connected to the second cylinder portion 1232 of the third radiator 123 by pressing to co-form the shape of the antenna 100 of the FIG. 1.

In this embodiment, the dimensions of the antenna 100 are approximately 7 mm×5 mm×5 mm.

Figure 2:
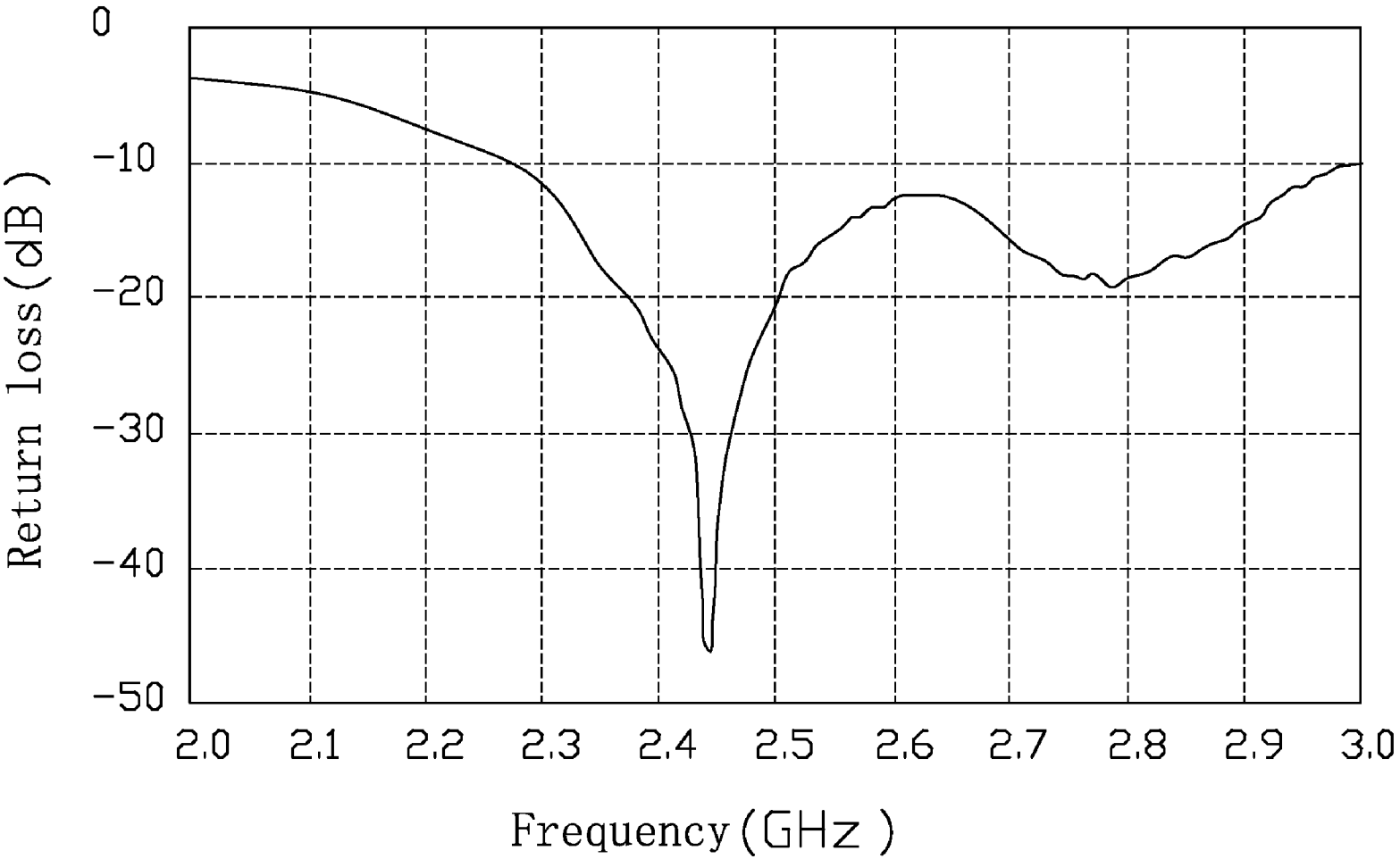
FIG. 2 is a graph showing return loss of the antenna of FIG. 1.

FIG. 2 is a graph showing return loss of the antenna 100 of FIG. 1. As shown, when the antenna 100 operates at a frequency of approximately 2.4 GHz in compliance with Wi-Fi standard, the return loss is less than −10 dB.

Figure 3:
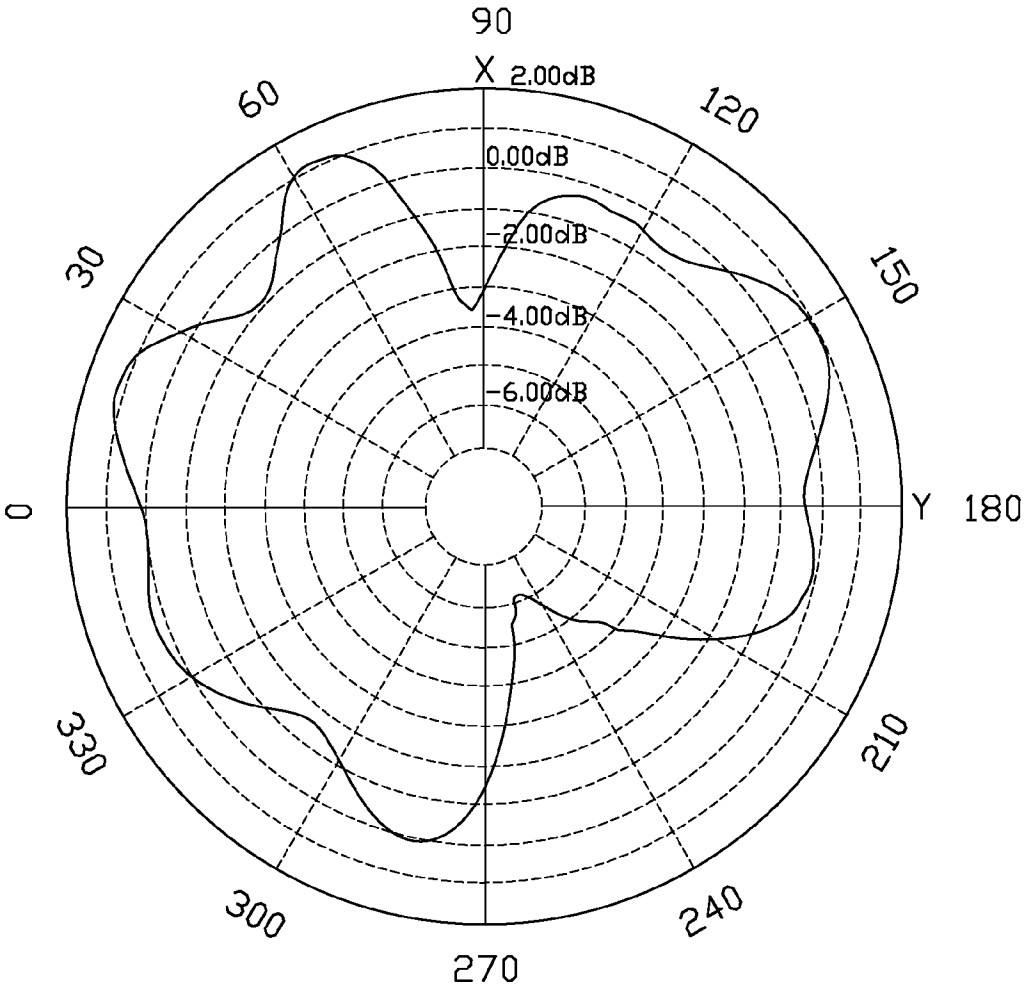
FIGS. 3-5 are test charts showing radiation patterns respectively on X-Y plane, X-Z plane and Y-Z plane when the antenna of FIG. 1 operates at the frequency of approximately 2.4 GHz.
Figure 4:
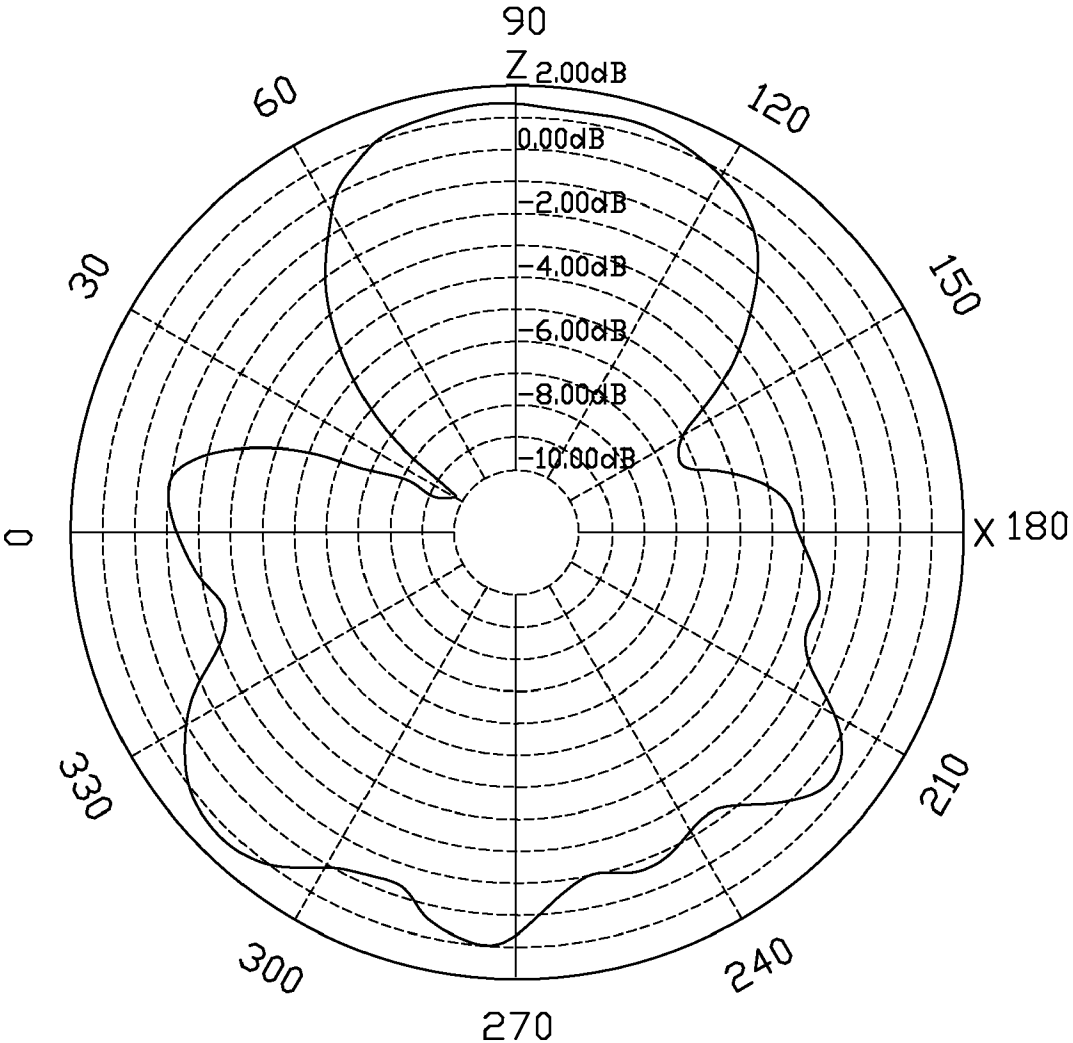
Figure 5:
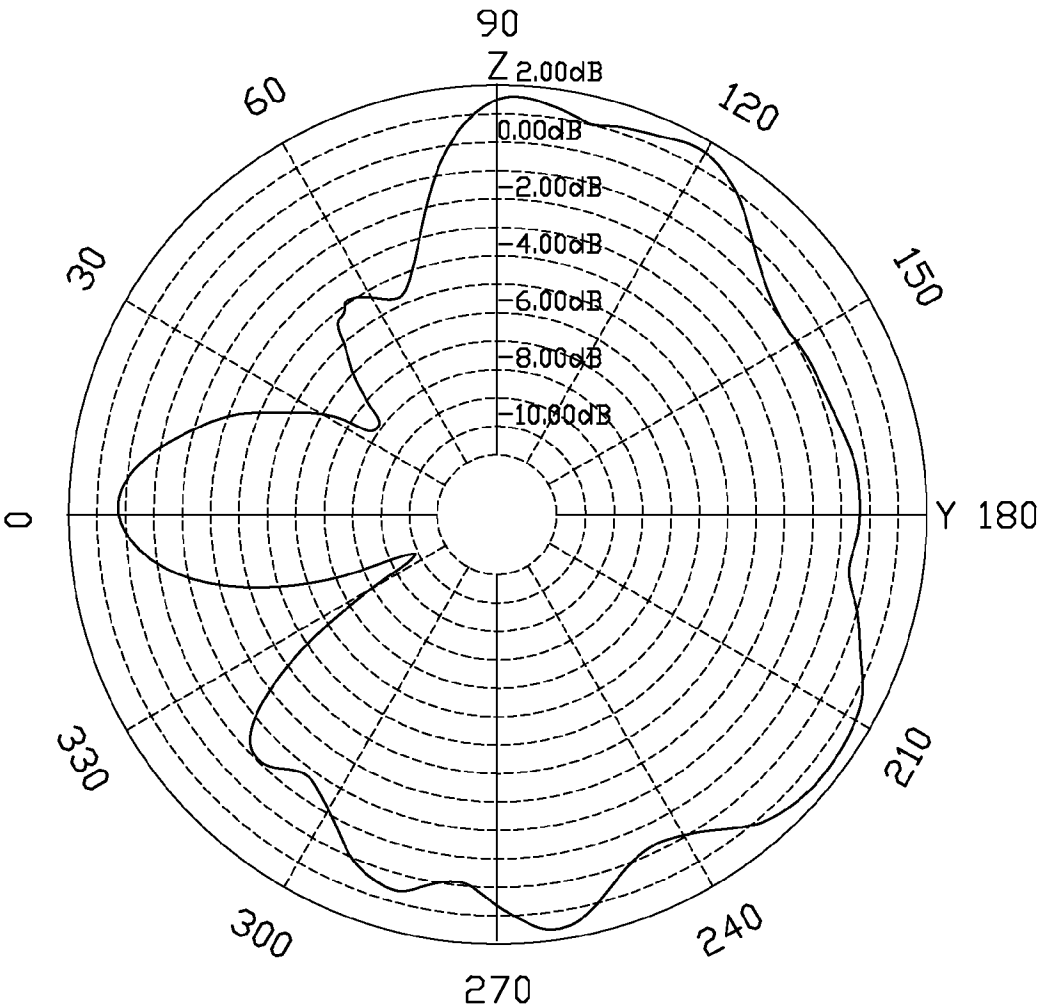

FIGS. 3-5 are test charts showing radiation patterns respectively on X-Y plane, X-Z plane and Y-Z plane when the antenna of FIG. 1 operates at the frequency of approximately 2.4 GHz in compliance with IEEE 802.11 standard.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An antenna, disposed on a first substrate and a second substrate, comprising:

a feeding portion disposed on a first surface of the first substrate for feeding electromagnetic signals; and a radiating portion electronically connected to the feeding portion for transceiving the electromagnetic signals, comprising:

a first radiator disposed on the first surface of the first substrate and electronically connected to the feeding portion;

a second radiator disposed on a second surface of the second substrate; and a third radiator comprising a first cylinder portion and a second cylinder portion electronically connected to the first cylinder portion, the first cylinder portion and the second cylinder portion being electronically connected to the first radiator and the second radiator, respectively, wherein a radius of the first cylinder portion is bigger than that of the second cylinder portion, and the first cylinder portion and the second cylinder portion co-form a metal spring thimble.

2. The antenna as recited in claim 1, wherein the first surface of the first substrate faces the second surface of the second substrate.

3. The antenna as recited in claim 1, wherein the first radiator comprises a first rectangle-shaped portion, an S-shaped portion, and an L-shaped portion connected in sequence, the rectangle-shaped portion is electronically connected to the first cylinder portion, and the L-shaped portion is electronically connected to the feeding portion.

4. The antenna as recited in claim 3, wherein the second radiator comprises a second rectangle-shaped portion and an n-shaped portion connected to the second rectangle-shaped portion, and the rectangle-shaped portion is electronically connected to the second cylinder portion.

5. The antenna as recited in claim 1, wherein the second radiator and the third radiator can be connected and disconnected flexibly.

6. A wireless local area network (WLAN) antenna, comprising:

a feeding portion disposed on a first plane for feeding electromagnetic signals; and a radiating portion electronically connected to the feeding portion for transceiving electromagnetic signals, comprising:

a first radiator disposed on the first plane, and connected to the feeding portion;

a second radiator disposed on a second plane, wherein the first plane is paralleled to the second plane; and a third radiator being a spring thimble formed by two cylinder portions with different radius, and resiliently connecting the first radiator to the second radiator.

7. The WLAN antenna as recited in claim 6, wherein the second radiator and the third radiator are disconnectable.

8. An antenna assembly comprising:

a first substrate defining a first plane;

a second substrate spaced from said first substrate and at least one part of said second substrate overlapping said first substrate along a direction intersecting both of said first and second substrates, said second substrate defining a second plane facing said first plane; and an antenna disposed on said first and second planes, said antenna comprising a feeding portion disposed on said first plane for feeding electromagnetic signals, and a radiating portion electrically connectable with said feeding portion for transceiving electromagnetic signals, said radiating portion comprising a first radiator disposed on said first plane to electrically connect with said feeding portion, a second radiator disposed on said second plane, and a third radiator disposed between said first and second planes to electrically connect with said first radiator and said second radiator respectively;

wherein said third radiator is a spring thimble formed by two cylinder portions with different radius.

9. The antenna assembly as recited in claim 8, wherein said first and second radiators respectively comprise a rectangle-shaped portion wider than other portions thereof to electrically connect with said third radiator.

* * * * *